US006321654B1

(12) United States Patent
Robinson

(10) Patent No.: US 6,321,654 B1
(45) Date of Patent: Nov. 27, 2001

(54) MICROELECTROMECHANICAL SYSTEMS (MEMS) -TYPE DEVICES HAVING LATCH RELEASE AND OUTPUT MECHANISMS

(75) Inventor: Charles H. Robinson, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/560,527

(22) Filed: Apr. 24, 2000

Related U.S. Application Data

(60) Provisional application No. 60/184,137, filed on Feb. 22, 2000.

(51) Int. Cl.[7] ..... F24C 15/24
(52) U.S. Cl. ..... 102/251
(58) Field of Search ..... 102/222, 235, 102/247, 251, 202

(56) References Cited

U.S. PATENT DOCUMENTS 5,705,767 * 1/1998 Robinson ..... 102/231
6,064,013 * 5/2000 Robinson ..... 200/61.53
6,167,809 * 1/2001 Robinson et al. ..... 102/235

* cited by examiner

*Primary Examiner*—Charles T. Jordan
*Assistant Examiner*—J Lofdahl
(74) *Attorney, Agent, or Firm*—John F. Moran

(57) ABSTRACT

A first embodiment of the invention comprises a miniature release and latch anchor assembly that can be fabricated in combination with other moving and fixed elements on a single substrate (3). Such a release and latch anchor assembly has many applications in MEMS-type devices, particularly devices whose moving elements react in response to predetermined inertial loading inputs externally imposed thereupon. This embodiment provides ways of imposing or enforcing sequential operations of moving parts in a MEMS-type device, a necessary operational requirement for safety and proper arming of projected munitions. A second embodiment of the invention is a variation of the first embodiment wherein a reinsertable-re-releasable latch anchor assembly mechanism has insertable anchor feet members (5) in cooperation with the linchpin member (7) whereby re-latching of the anchor assembly can occur. A third embodiment of the invention comprises various designs of mechanical output pin (25) in various assemblies for relay functioning. These output pin assemblies are part of an integrated or coupled MEMS-type device that mechanically closes or opens an output actuated device such as a valve, electrical contacts or optical transmitting device.

29 Claims, 13 Drawing Sheets

MICROELECTROMECHANICAL SYSTEMS (MEMS) -TYPE DEVICES HAVING LATCH RELEASE AND OUTPUT MECHANISMS

CROSS-REFERENCE TO RELATED APPLICATIONS

This application claims priority from U.S. Provisional Application Ser. No. 60/184,137 filed on Feb. 22, 2000. Also, this application is related to U.S. patent application Ser. No. 09/192,805 filed Nov. 5, 1999 entitled "ULTRA-MINIATURE, MONOLITHIC, MECHANICAL SAFETY-AND-ARMING (S&A) DEVICE FOR PROJECTED MUNITIONS," and U.S. patent applications entitled, "Microelectromechanical System (MEMS)-Type High-Capacity Inertial-Switching Device" and "Ultra-Miniature Mechanically Enabled Detonator with Safety and Arming Device," filed herewith, the contents of which are expressly incorporated in their entirety herein.

U.S. GOVERNMENT INTEREST

The invention described herein may be manufactured, used, and licensed by or for the U.S. Government for U.S. Government purposes.

FIELD OF THE INVENTION

The present invention relates generally to microelectromechanical systems (MEMS)-type devices and, more particularly, to MEMS-type devices having latch, release and output mechanisms for use in fuze safety and arming devices.

DESCRIPTION OF THE PRIOR ART

Explosive projectiles, such as mortar shells, artillery shells and other similar projectiles, normally have a S&A device, which operates to permit detonation of the explosive only after the projectile has been fired or launched. Thus, mechanical arming delay mechanisms for such projectiles or explosives are well known in the art.

For example, three-dimensional rotary or linear zigzag delay (that is, inertial delay) devices on the scale of millimeters or centimeters, fashioned by precision machining, casting, sintering or other such "macro" means, have previously been used to provide a mechanical delay before closing a switch, or removing a lock on a detonator slider in a fuze S&A device. Such devices are disclosed, by way of example, in U.S. Pat. Nos. 4,284,862 and 4,815,381. However, fabrication of such devices is costly since such devices are constructed from extremely precision components, often requiring time-consuming component sorting, thus limiting their use.

Other mechanical arming delay mechanisms include sequential falling leaf-spring mechanisms and escapement mechanisms. The technology surrounding such devices also includes rotors or sliders which, as arming proceeds, move out-of-line fire-train components toward and into an in-line position. Typically, the out-of-line element is a detonator or squib (propellant initiator). In such devices, the rotor or slider can remove an explosive barrier that has blocked function of the fire train, thereby arming the device.

Finally, such devices also include arrangements wherein mechanical sequential interlocks control the motion of the slider/rotor such that an out-of-sequence actuation of the interlocks leads to a fail-safe condition. An example of out-of-sequence actuation is a spin lock releasing an arming slider before a setback lock has functioned to release the arming slider.

Overall, prior art arrangements are such that mechanical fuze S&A devices comprise complicated, three-dimensional assemblies of piece-parts working together inside of a frame, collar or support housing. The piece-parts interact to provide dual-environment, out-of sequence safety and arming functions. Complexity comes from the need for pins, screws, bushings, specialty springs, lubrication, dissimilar materials, and assembly, as well as a need for maintaining small tolerances on all parts for trouble-free operation.

In summary, there is a need in the fuze arts, as similarly discussed in related U.S. patent applications referenced above, for ultra-miniature, monolithic, mechanical fuze S&A devices for munitions. More particularly, there is need for fuze mechanical S&A device designs that are significantly smaller and more reliable, which have varied electrical control switching action, thereby providing more space in the munitions for payload or electronics. In addition, there is need for development of a fuze S&A device fabrication techniques that can replace or reduce dependence on a disappearing, domestic precision small-parts manufacturing base. Furthermore, there is need for development of fuze S&A device designs that allow fuze developers and manufacturers to make changes to design thereof involving non-complex exposure-mask and process-parameter changes to the MEMS micromachining process, compared to expensive factory retooling currently used to achieve the same goal when using conventional mechanical components. Additionally, there is need for improvement in the ease with which mechanical S&A devices interface and integrate with increasingly electronics-intensive fuze architectures. Moreover, there is a need for the development of improvements in potential shelf-life of mechanical S&A devices, taking advantage of characteristics of microscale moving parts that do not require lubrication, which can degrade with time, to function. Finally, there is a need for an increase in safety and reliability in fazing using safety and arming devices by taking advantage of the ease with which redundant functions may be built and tested in high-rate micromachining production processes.

Such needs are addressed by further research and development of LIGA (LIthographie, Galvanoformung, Abformung, for "lithography, electroplating, molding") and other micromachining processing methods that use metals, polymers and even ceramics for the production of varied microstructure-type devices having extreme precision. These microstructures are microelectromechanical systems (MEMS)-type devices that are alternatives for conventional electromechanical devices such as relays, actuators, and sensors. MEMS-type devices are potentially lower in cost to produce, due to the use of microelectronic fabrication techniques and when properly designed, MEMS-type actuators can produce useful forces and displacement, while consuming reasonable amounts of power.

Using MEMS micromachining methods, I previously disclosed a miniature, planar, inertially-damped, inertially actuated delay slider actuator member micromachined on a substrate, which included a slider in cooperation with a zig-zag or stair-step-like pattern on side edges to provide a time delay mechanism for a S&A device, taught in my U.S. Pat. No. 5,705,767, discussed below. The present invention provides additional designs for such devices in view of the above listed needs in the fuze arts.

OBJECTS AND SUMMARY OF THE INVENTION

It is a primary object of the present invention to provide latch, release and output mechanisms for MEMS-type devices, which resolves many of the problems discussed above.

It is another object of the present invention to provide novel MEMS-type latch/release anchor mechanisms and latching output relay mechanisms, which incur lower production cost compared to current macro-sized devices having similar capabilities.

It is yet another object of the present invention to provide a MEMS-type inertial relay device using these mechanisms within a S&A device of a fuze within projected munitions.

Briefly, various designs of latch and release mechanisms and output mechanisms of a MEMS-type device are provided. The invention provides means by which "mechanical logic," in the form of enforced sequential action of moving components, can be implemented in a planar MEMS-type device. The implementation of this mechanical logic is not limited only to a preferred S&A device of a fuze, but can also be used in many non-fazing applications as well.

A first embodiment of the invention comprises a miniature release and latch anchor assembly that can be fabricated in combination with other moving and fixed elements on a single substrate. Such a release and latch anchor assembly has many applications in MEMS-type devices, particularly those devices whose moving elements react in response to a predetermined inertial loading impetus externally imposed thereupon. Applications of the invention include industrial, commercial, military, or space-type use. In particular, this embodiment provides ways of imposing or enforcing sequential operations of moving parts in a MEMS-type device, a necessity for safe and proper arming of projected munitions. Generally, such munitions must experience a sequence of input conditions prior to arming the fuze. More particularly, this embodiment's release and latch anchor assembly comprises a relatively massive slider member having anchor foot members attached by leg members. The slider member is secured by constriction members attached to a substrate base and a latching linchpin member interposed between the leg members. These components are formed on a single die. When the MEMS-type device experiences an initiating event to enable the release functioning of this embodiment, the anchor linchpin member disengages and allows the slider member to move within a track that is also attached to the substrate base. The anchor foot members have a one-way catch that prevents relatching of the slider member once the anchor legs slide out from and egress from these constriction members that are attached to the base. Then, when subsequent inertial loading of the MEMS-type device occurs, the slider member can effectuate proper sequential functioning of the device.

A second embodiment of the invention is a variant of the first embodiment comprised of a reinsertable-re-releasable latch anchor assembly that has reinsertable anchor foot members in cooperation with a linchpin member that has spring biasing whereby relatching of the anchor assembly can be effectuated when the slider member is forced back into the constrictions.

A third embodiment of the invention comprises various designs of mechanical output pin assemblies for proper sequenced relay functioning in a MEMS-type device. These output pin assemblies are part of an integrated assembly or coupled to a MEMS-type device, which enable proper operational states of closing or opening of an ancillary device such as a fluid valve, electrical switches, mechanical displacement of an optical switching device.

These embodiments of the invention are preferably used in a safety and arming (S&A) device of a fuze. The S&A device includes the embodiments of the invention in exemplary form using the latch release anchor assembly and the output relaying device in MEMS-type devices.

The above remarks, and other objects, features and advantages of the present invention will become apparent from the following description read in conjunction with the accompanying drawings, in which like reference numerals designate similar elements or assemblies.

DETAILED DESCRIPTION OF THE PREFERRED EMBODIMENTS

First Embodiment of Invention

Figure 1A:
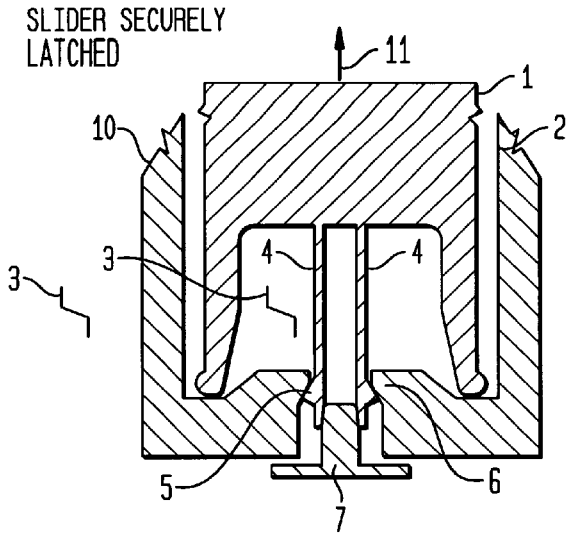
FIGS. 1*a*, 1*b* and 1*c* show sectional plan views of a latched and releasable MEMS slider anchor assembly showing the transition from the latched to the released positions.
Figure 1B:
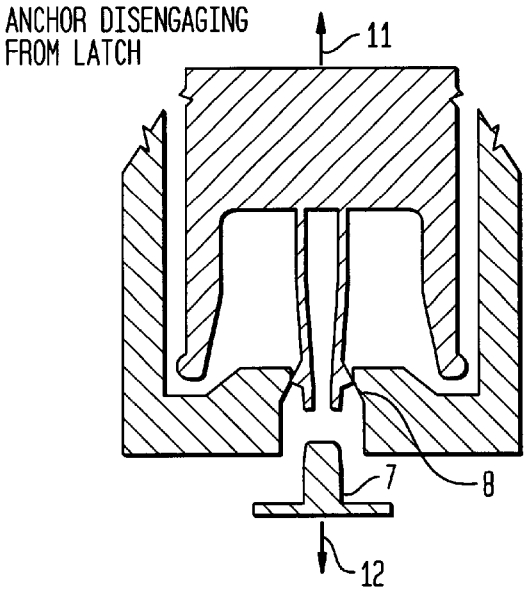
Figure 1C:
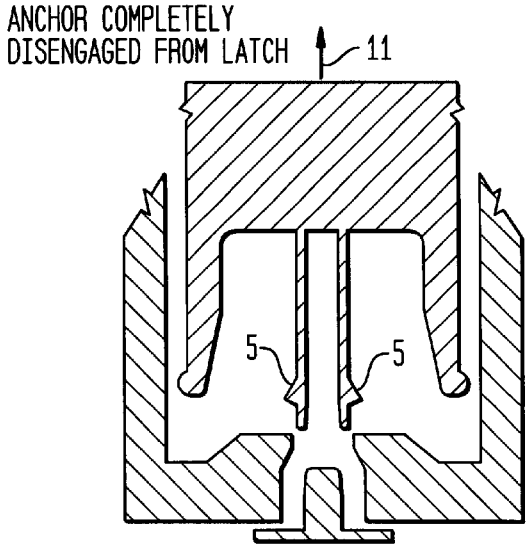

Referring to FIGS. 1*a*, 1*b* and 1*c*, sectional plan views of a MEMS-type device's anchor assembly for a latched/ releasable slider showing sequential operation thereof. In FIG. 1*a*, the assembly comprises a movable latched and anchored MEMS slider member 1 that slides within a slider track 2 and is housed within an enclosure that is attached to the substrate 3. Flexible anchor legs 4 with anchor "feet" 5 on the ends that are caught in a constriction or "catch" 6 while being held apart by movable linchpin 7. Each foot member 5 is shaped to bear laterally against constrictions 6 that have cam faces and are attached to the upper substrate 3. The feet are pinned and subsequently can slide past the constriction members when movable linchpin 7 is moved out from between the anchor feet 5, and the slider member 1 is pulled upwards by inertial force 11 when activated. An output relay assembly can then be activated by the slider member discussed below.

When the linchpin 7 is removed, the gap between the left and right anchor feet 5 is sufficient for the feet to deflect towards each other without interference to exit the constriction 6, which is a symmetrical throat area that traps the anchor feet. The anchor legs 4 have a length and thickness/height (cross section) aspect that provides correct bending stiffness that, in combination with the constriction cam face 8 angle and material friction coefficient, determines the force threshold 11 for pulling the feet upward, out of the unpinned lock as shown in FIG. 1*b*. A cantilever beam equation describes the stiffness of the anchor legs as a function of the three-dimensional geometry and the modulus of the material. Making the MEMS slider mass 1 with opposed symmetrical anchor legs held in a symmetrical constriction avoids cocking/jamming of the slider member in the track in which it slides, but a one-sided deflection can work if the cam face angularity of the constriction is small.

The anchor feet 5 are shaped to bear laterally against the constriction's 6 cam face 8 while pinned and then slide past the constriction when the linchpin 7 is moved downward and out from between the feet, and the slider member is pulled upwards. When the linchpin is removed, the gap between the left and right anchor legs and feet is sufficient for the feet to be deflected towards each other without interference to exit the constriction.

The constriction 6 is a symmetrical throat area that traps the anchor feet 5 as shown in FIG. la. The constriction 6 is fixed to the substrate 3 and made integral to the land structure 10 that is also attached to the substrate base 3. The substrate 3 supports and affixes other fixed features of the device, such as track 2. The angle of the cam face 8 partially determines the force and stroke necessary to pull the feet through the constriction. A more vertical angle makes it easier to pull the feet through the constriction, but means a longer pullout stroke for a given amount of lateral deflection of the anchor feet.

The linchpin 7 spaces the anchor feet apart and prevents them from clearing the constriction 6. The linchpin can be pulled out of the lock by some applied downward force 12 to allow the anchor feet to pull through the constriction.

In some applications of the invention, there may be no load on the linchpin when it is removed. See FIG. 14 in which the zig-zag inertial delay slider 15 moves downward while the chip is accelerated upward due to launch setback acceleration, and in doing so pulls down the linchpin release arm 9 while the pin 7 is completely unloaded by the anchor feet. After the zig-zag mass is down and latched, the acceleration field in the projected munitions reverses (due to set forward acceleration) and the set forward slider is able to pull the unpinned anchor feet upward through the constriction.

Figure 2A:
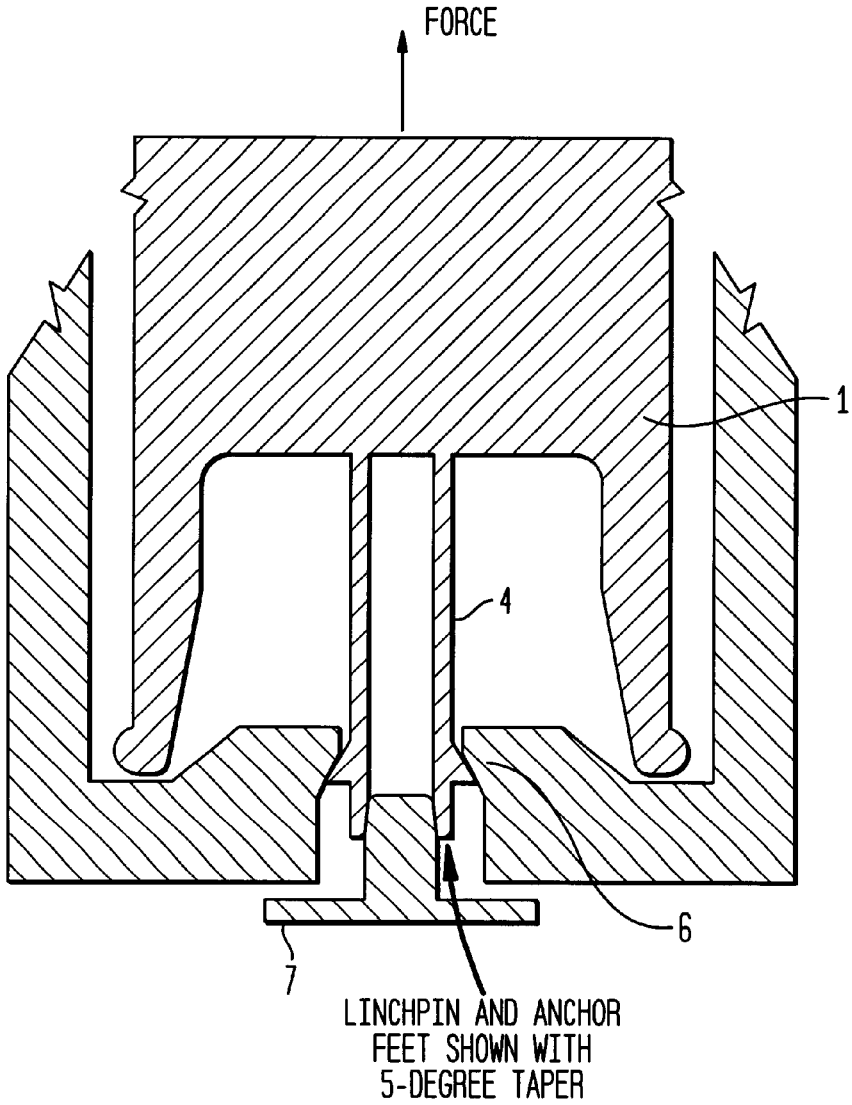
FIGS. 2*a*, 2*b* and 2*c* show a sectional plan views and details of the MEMS latch/release anchor assembly.
Figure 2B:
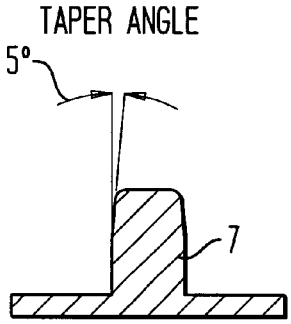
Figure 2C:
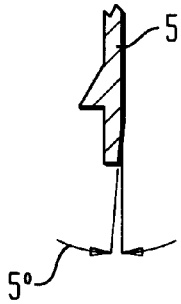
Figure 3:
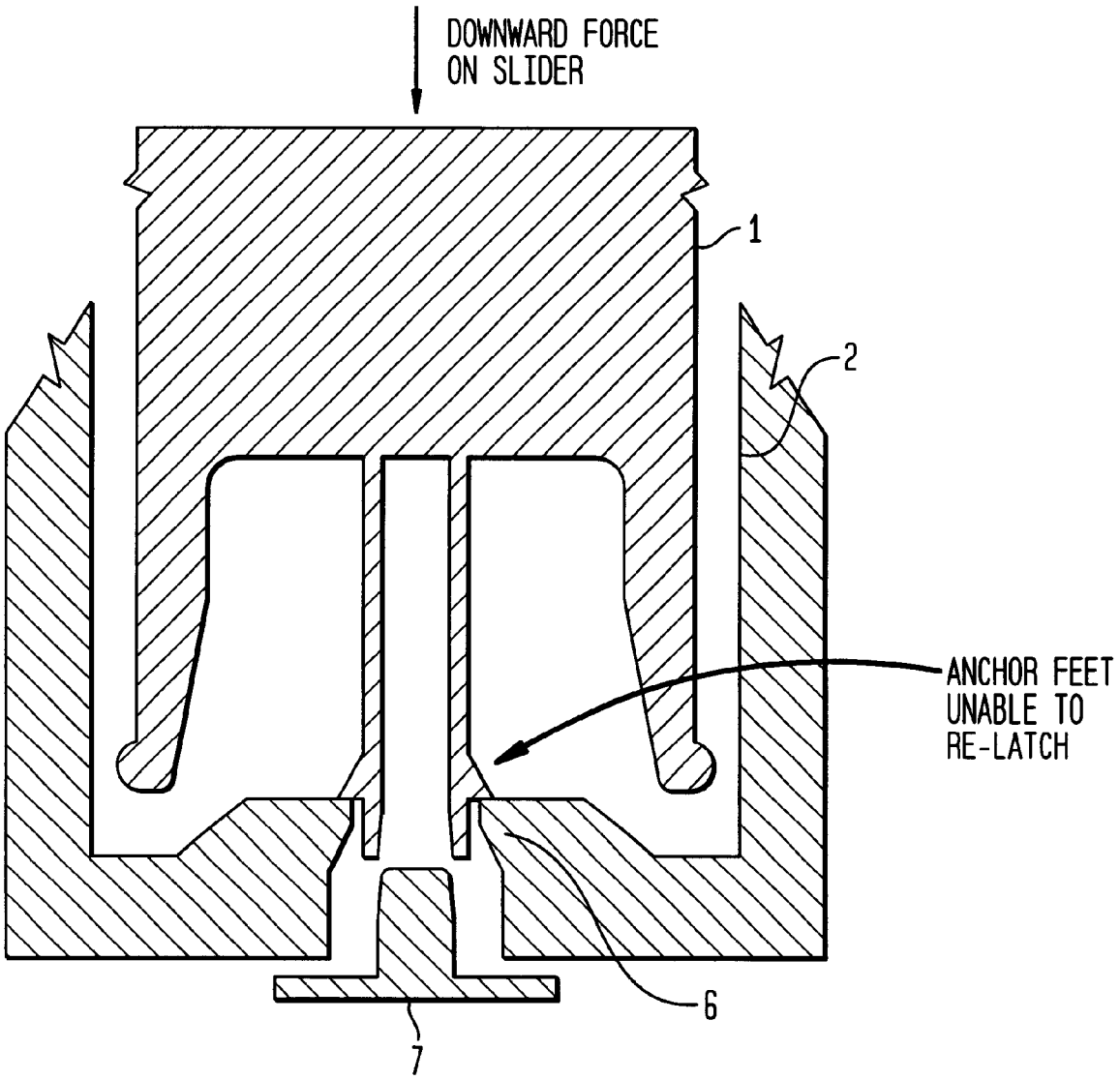
FIG. 3 shows a sectional plan view showing features of the anchor assembly that prevents re-entry into the lock.

In other applications it may be necessary to remove the linchpin while an upward load is on the set forward slider. If the linchpin must be pulled from the lock while under load from the anchor feet (e.g., while the device is being accelerated downward so there is an upward inertial force on the slider), a taper can be added to facilitate this pullout, see FIGS. 2*a*, 2*b* and 2*c*.

Also, the actuating inputs to the linchpin of the anchoring assembly can be other than inertial induced forces (for example, they can be electrical (static electric or electric motor), magnetic, or fluidic effectuating mechanisms. The preferred exemplary embodiment discussed herein is only one use for a latching mechanism. Variations of this embodiment include the slider member 1 that can be replaced by other cooperative mechanical elements that include the anchor assembly. For instance, instead of an anchored set forward mass, the anchor assembly could latch down part of an actuator or other mechanical element(s).

Operation of the First Embodiment

While Latched: The anchored or latched slider member shown in FIG. 1*a*, is strongly secured. No force in lateral, up, or down directions can pull the anchor feet free of the constriction so long as the linchpin remains in place between the feet, the tensile strength of the anchor legs is not exceeded, and a cover plate holds the moving parts in plane, see FIG. 15. Thus the device is capable of "holding off" large forces or loads encountered in civilian or military applications. These loads especially include those associated with the military logistic environment, such as transportation vibration, and handling/mishandling drop impacts, as well as those of munitions loading in the breech of a gun. The invention can "hold off" these forces or loads while still being responsive and functional when the proper launch environments are encountered.

Latch Releasing: Latch release shown in FIG. 1*b* is effected by moving the linchpin downward from between the anchor feet. There is no friction force to overcome during latch release if the linchpin is removed while the anchor legs are undeflected/unloaded. There will be some friction that must be overcome to remove the linchpin if there is a pinching load applied by the anchor feet (i.e., when the mass is being drawn upward by a force). The linchpin can include a taper to facilitate removal while loaded as shown in FIG. 2.

Latch Released, Mass Underway: Motion of the slider member upwards in its slide track is possible when the linchpin has been removed from between the feet and there is an upward force on the mass sufficient to pull the feet through the constriction FIG. 1*c*. The pull-out threshold force and linear stroke of the latch release process will vary according to the following design parameters (pull-out stroke is the amount of axial movement necessary from the beginning of upward slider motion to where the feet are free of the latch): a) Spring stiffness of the anchor legs, a function of beam cross-section, material modulus, and length; b) Amount of bending deflection necessary for anchor feet to clear the constriction (shape and position of feet and constriction cam); c) Angle of incline of the constriction cam along which the anchor feet have to slide; and d) Coefficients of static and dynamic friction.

Referring to FIGS. 2*a*, 2*b*, 2*c* and 3, The anchor assembly is shown in detail. Once the anchor feet pull through the constriction members 6, they cannot re-enter, and the mass cannot be re-anchored, because the anchor feet are shaped to prevent re-entry, with the straight horizontal edge of the anchor foot cam catching on the upward part of the constriction, see the details in FIGS. 2*b* and 2*c*. Thus, the device of this section is one-way, latching/releasing.

In summary, this embodiment of the invention provides a relatively large slider member's mass that can securely be held in an anchored position by the anchor assembly, holding off the effects of transportation and handling shock and vibration inputs (even in the case of a gun launched munitions, holding off the large mechanical shocks of munitions breech loading and firing) and then it can subsequently be enabled or freed by a small force and stroke applied to the linchpin member.

Second Embodiment of the Invention

Figure 4A:
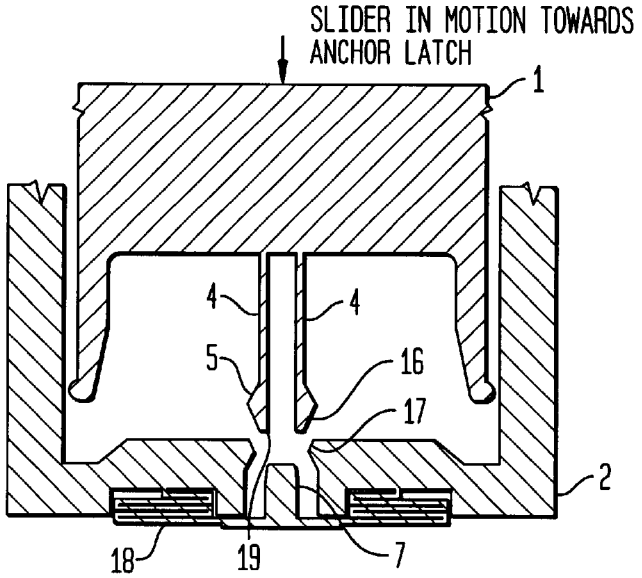
FIGS. 4*a*, 4*b* and 4*c* show sectional plan views showing the insertion phase of action with the insertable-removable anchor embodiment.
Figure 4B:
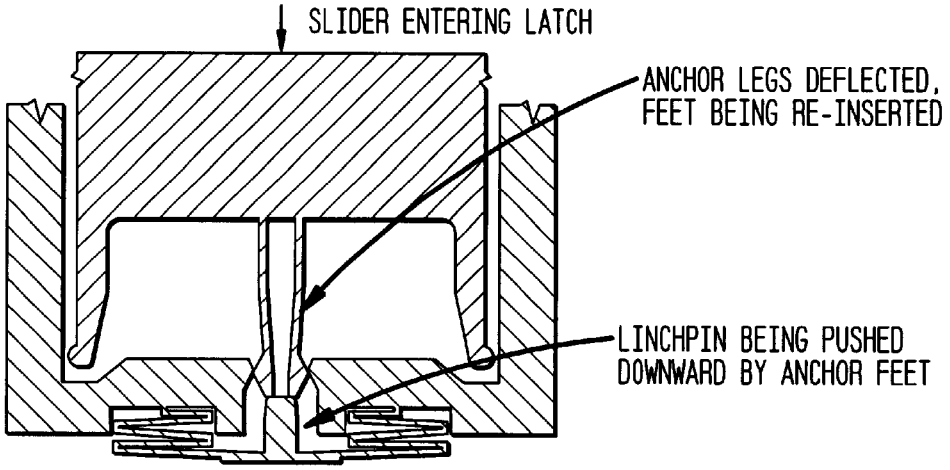
Figure 4C:
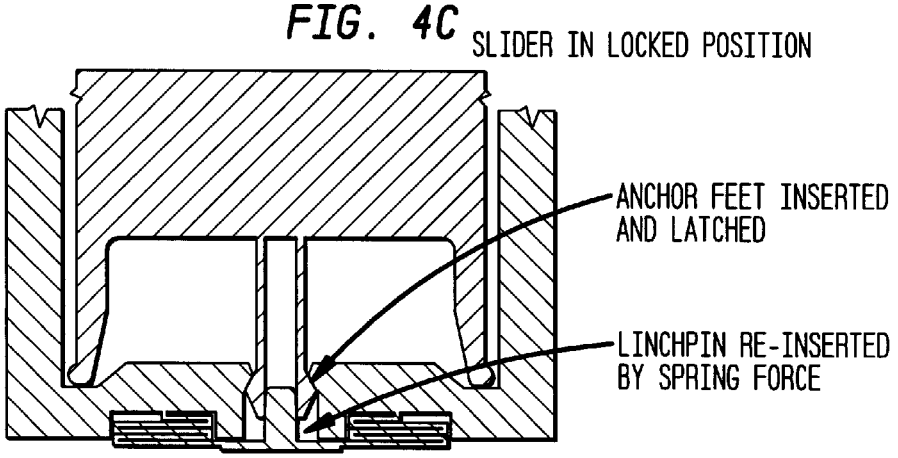
Figure 5A:
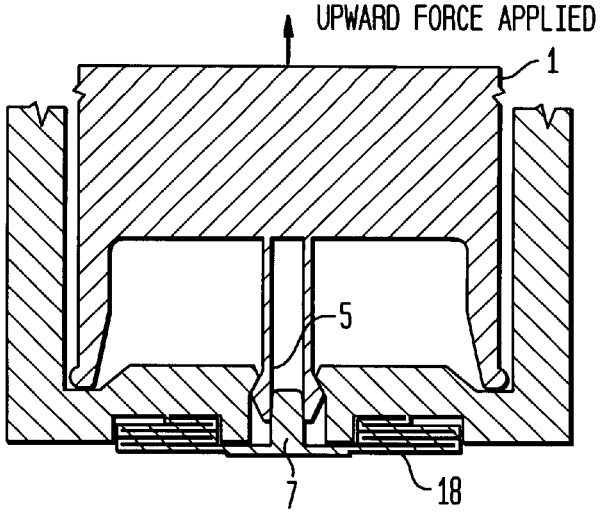
FIGS. 5*a*, 5*b* and 5*c* show sectional plan views of the unlocking and removal phase of action with the insertable removable anchor assembly embodiment.
Figure 5B:
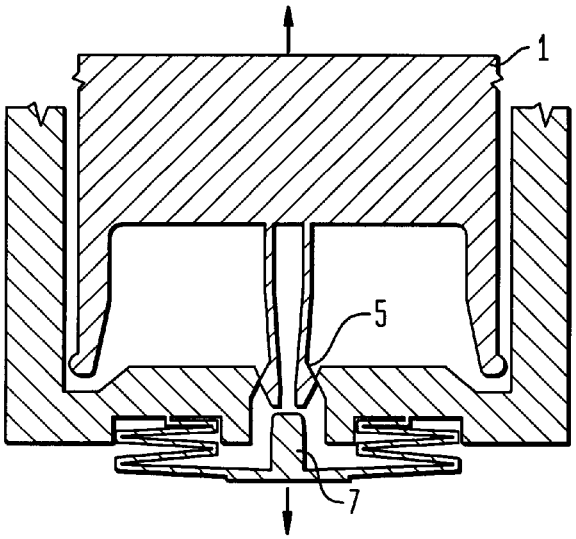
Figure 5C:
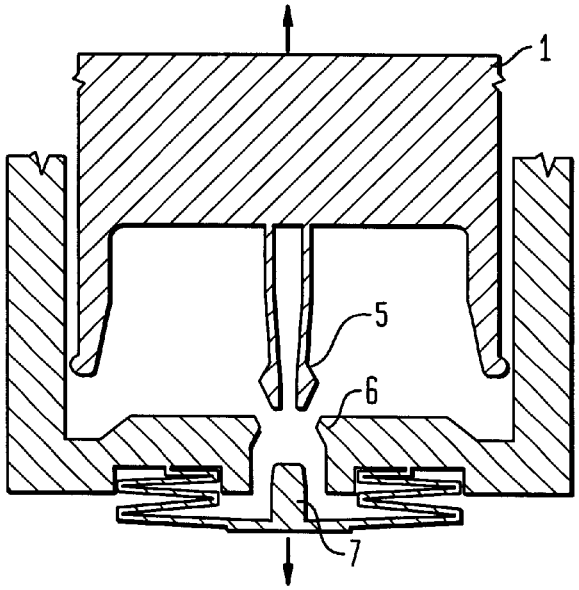
Figure 6A:
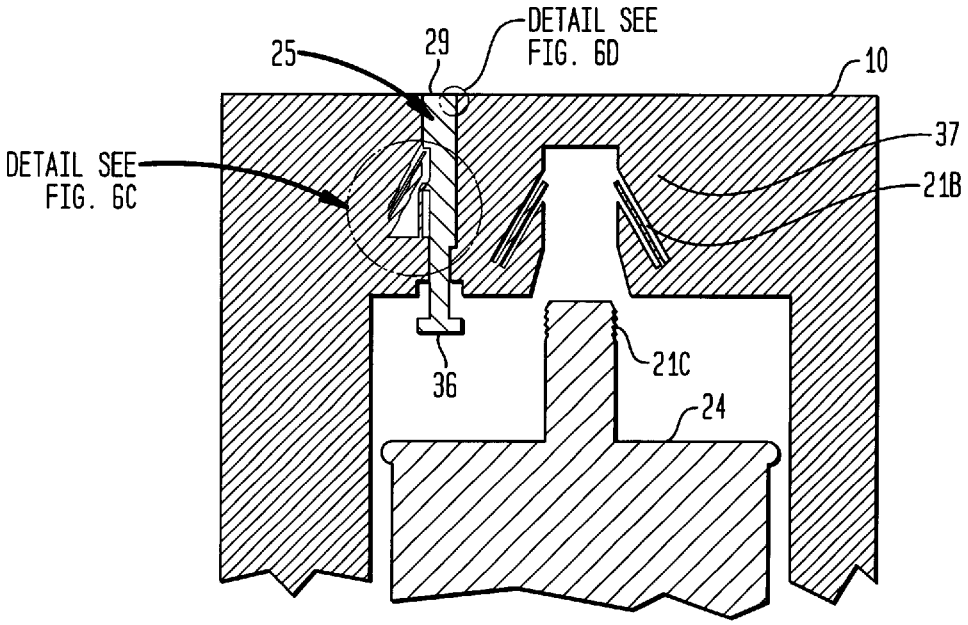
FIGS. 6*a*, 6*b*, 6*c* and 6*d* show sectional plan views of the mechanical output assembly of a pin when retracted (before action), when in an extended positions, and detailed views of ratchet springs and break away wall respectively.
Figure 6B:
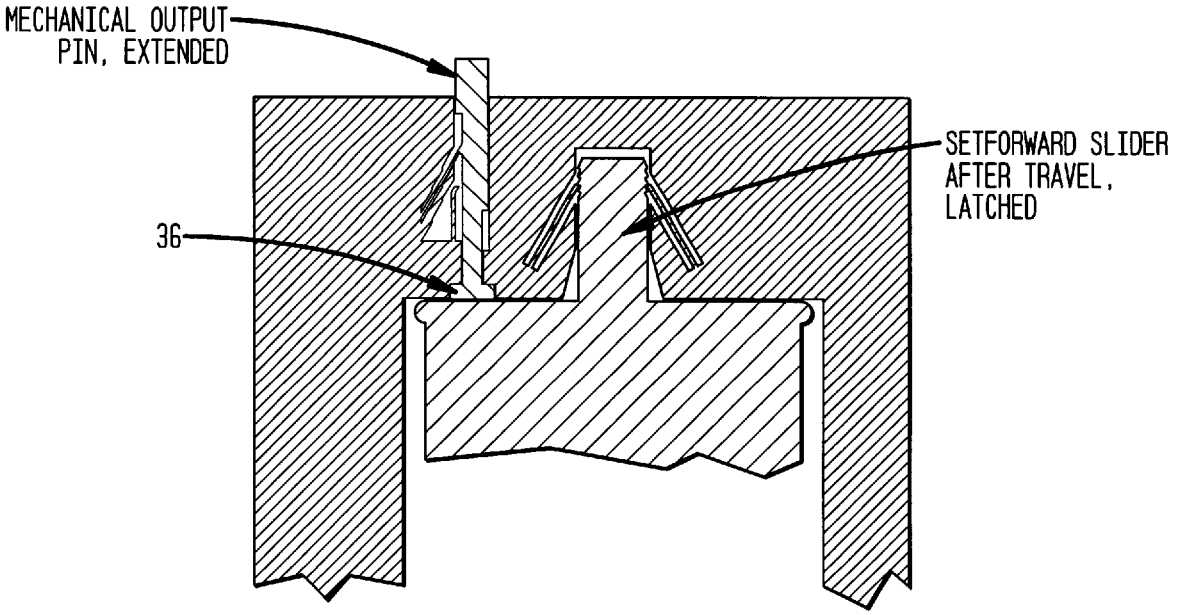
Figure 6C:
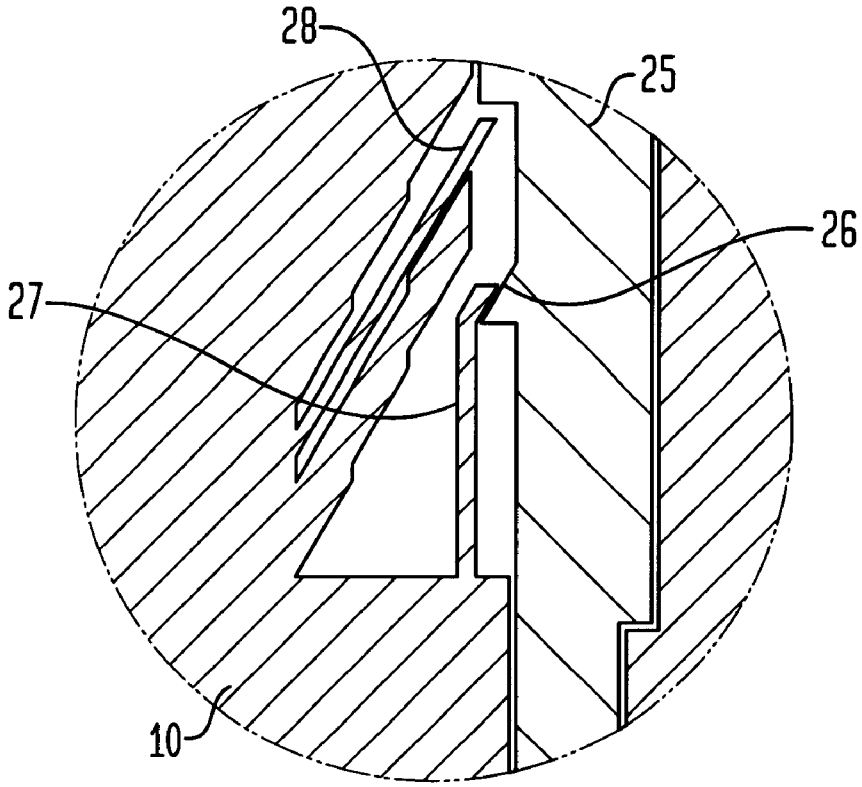
Figure 6D:
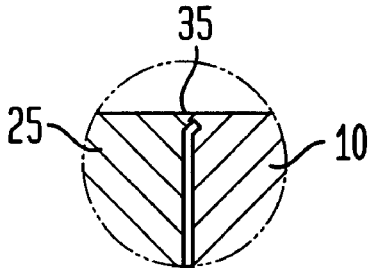

Referring to FIGS. 4*a*, 4*b*, 4*c*, 5*a*, 5*b* and 5*c*, views of an insertable-removable latch/anchor assembly are shown. In particular, FIG. 4*a* shows the under surface of the anchor feet are angled or beveled 16 to promote entry into the constriction when the slider mass 1 is moving downward from an unlatched toward a latched position. The entry way of the constriction 6 from above is no longer a right angle, but a bevel 17 has been added that guides the anchor feet into the lock. The linchpin 7 in this embodiment is suspended on a spring 18, and rests normally in its latching or locking (up) position. But as the anchor feet 5, 16 are pushed by the slider mass into the constriction, the lower extremities 19 of the feet bear upon the linchpin, forcing it downward, see FIG. 4*b* against the resistance of the spring. Under continued downward motion of the slider mass 1, the anchor feet clear the narrow throat of the constriction and begin to undeflect and follow the constriction cam surface laterally outward. When they are fully outward, the space between the feet has expanded enough to let the sprung linchpin snap to its position between the feet. The mass is now securely anchored, see FIG. 4*c*. Once the mass is securely anchored this way, it can only be freed by an outside influence that pulls the linchpin once again out of the lock. If that outside influence is exerted and the linchpin is pulled down, the situation is similar to the first embodiment discussed above, and the anchor feet can be pulled out of the latch by an upward force on the slider mass, shown in FIGS. 5*a*, 5*b* and 5*c*.

The second embodiment of the invention provides an additional functioning to the first embodiment discussed above wherein the slider mass can go from a free/unlatched position into a latched/anchored position or a latched/enabled position. The sequences of operational events of this embodiment are similar to the operations of the first embodiment as discussed above and the slider member can start out in its free position as shown in FIG. 4*a* and move downward to become anchored and locked, see FIG. 4*b* and 4*c*. Next, the slider member can start out in its free position as shown in FIG. 4*a* and move downward to become anchored but not locked. "Latched" refers to the anchor feet are fully inserted into the latch/constriction, "not locked" means that the linchpin is not inserted between the anchor feet. In this latched/non-locked condition, the slider mass is enabled to respond to a force input to go unanchored again. Subsequently, the linchpin can be caused to re-insert itself between the anchor feet. Because the second embodiment of the invention can also function in a similar manner as the first embodiment of the invention, it is more versatile and can combine uses. The same device can be used to latch, release, threshold, re-latch, etc. Moreover, positioning of the linchpin can be manipulated by a variety of ways rather than only by the inertial-slider member input pictured in the first embodiment. For instance, this positioning of the linchpin can be manipulated by thermal, electrostatic, or magnetic motive actuators, or force caused by a shape-memory alloy device, or any other means that can be integrated with the die on which the invention fabricated.

Third Embodiment of the Invention

Referring to the FIGS. 7–13, various mechanical output pin assemblies (discussed in FIG. 14) that are preferably used in combination with a MEMS-type S&A device are shown. These output pin assemblies in association with an integrated or coupled MEMS-type or miniature non-MEMS-type device provide mechanical closing or opening of an output function as shown in FIGS. 7 and 8 or mechanical displacement of an optical fiber shown in FIG. 9.

Figure 7A:
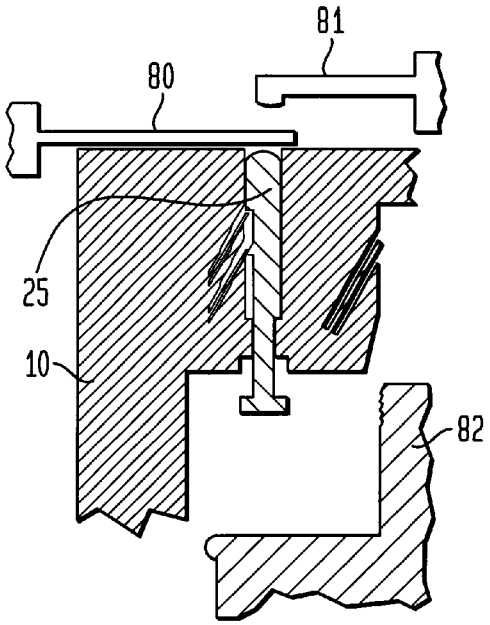
FIG. 7*a* shows a sectional plan view of the mechanical output assembly's pin ready to close a NO-type switch.
Figure 7B:
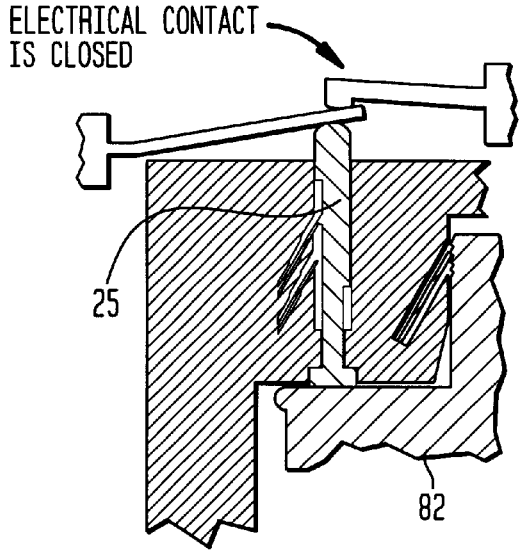
FIG. 7*b* shows the mechanical output assembly's pin extended and closing the switch shown in FIG. 7*a*.

In FIG. 7*a*, the flexible electrical contact arm 80 is deflected upwards by the action of the mechanical output pin 25 when it is extended by the action of the actuation slider 82 to where it pushes against an electrical contact 81 and thus closes an electrical circuit. In FIG. 7*b*, the circuit is shown closed by the action of the mechanical output pin 25 pressing the contacts together.

Figure 8A:
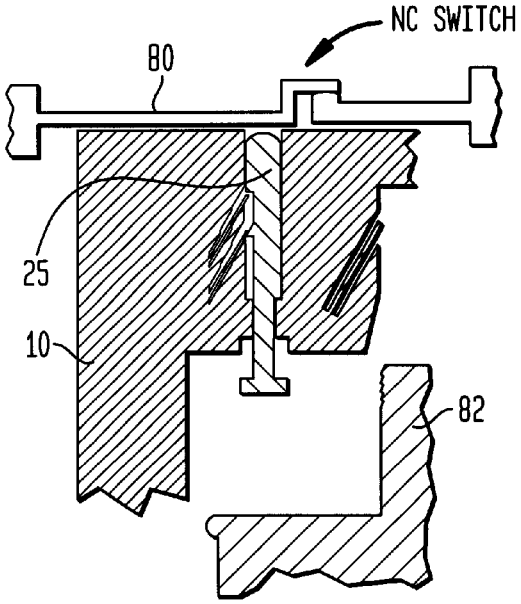
FIG. 8*a* shows a sectional plan view of the mechanical output pin ready to open a NC-type switch.
Figure 8B:
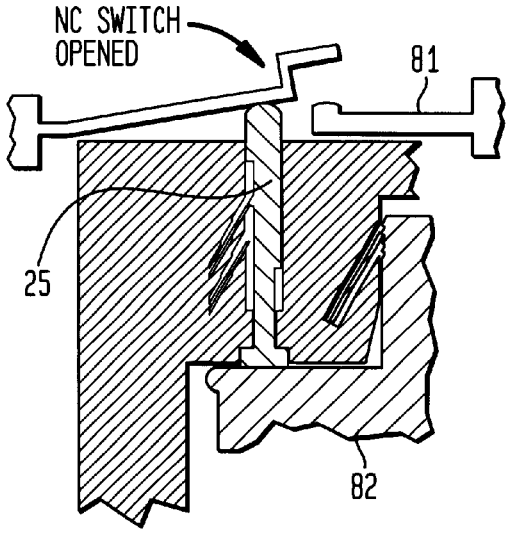
FIG. 8*b* shows the mechanical output pin extended and opening the switch shown in FIG. 8*a*.

In FIG. 8*a*, a normally closed (NC) switch configuration is shown in which the contact arm 80 and contact 81 are already in contact and the action of the mechanical output pin 25 is to separate the contacts by deflecting the contact arm 80 upwards, thus opening the switch as shown in FIG. 8*b*.

Figure 9A:
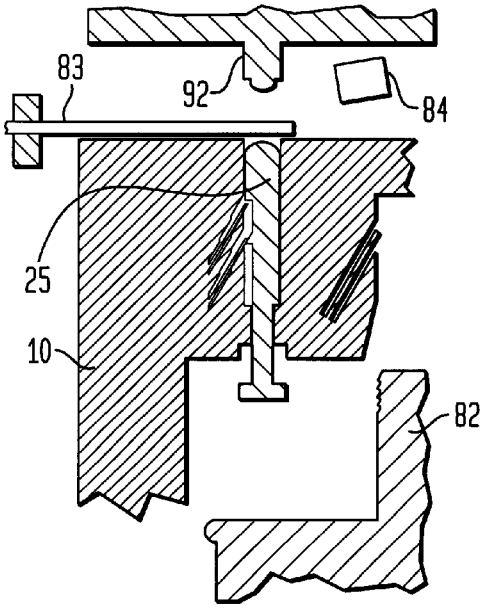
FIG. 9*a* shows a sectional plan view of the mechanical output assembly's pin ready to actuate a NO-type optical fiber switch.
Figure 9B:
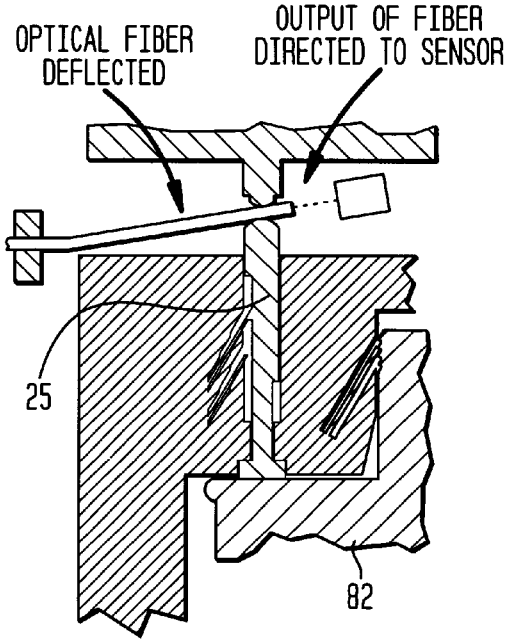
FIG. 9*b* shows the mechanical output assembly's pin extended and closing the switch in FIG. 9*a*.

In FIG. 9*a*, an optical fiber 83 takes the place of the flexible electrical contact arm 80, wherein its output normally points away from an optical sensor 84. In FIG. 9*b*, when the mechanical output pin 25 is extended by the action of slider 82, the output of the fiber 83 is redirected towards the optical sensor, thus closing an optical switch. A mechanical stop 92 is included to redirect the output optical fiber towards a fixed optical sensor. Alternatively, the pin 25 can also redirect a movable mirror element instead of the fiber element to effectuate optical switching.

Figure 10A:
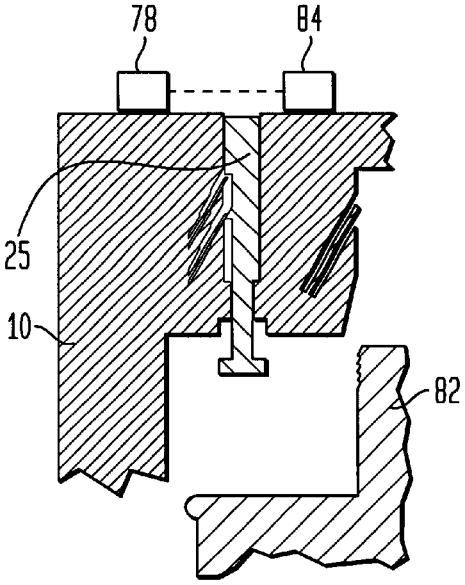
FIG. 10*a* shows a sectional plan view of the mechanical output assembly's pin used as part of a NC-type optical switch.
Figure 10B:
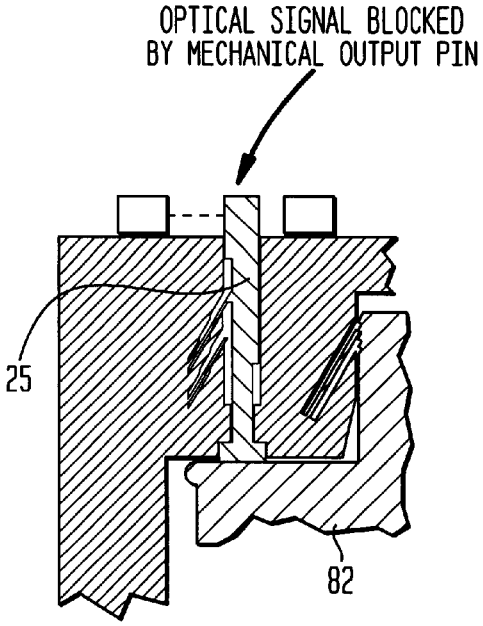
FIG. 10*b* shows the mechanical output pin extended and opening the optical switch shown in FIG. 10*a*.
Figure 10C:
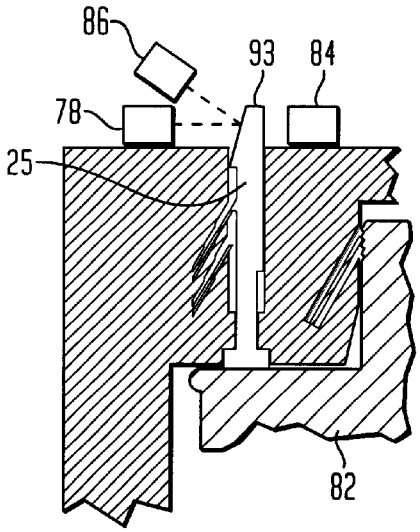
FIG. 10*c* shows a sectional plan view of the mechanical output pin used to control output to two channels using an optical switch.

Referring now to FIGS. 10*a*, 10*b* and 10*c*, a mechanism for mechanically blocking or redirecting a beam of electromagnetic energy (for example a laser beam) is shown. In FIG. 10*a*, light source 78 is shown with its output beam directed into optical sensor 84. This constitutes a closed optical switch. In FIG. 10*b*, the mechanical output pin 25 has been extended by the action of the slider 82, and now it blocks the light coming from the source, effectively opening the optical switch. In FIG. 10*c*, an arrangement is shown where the mechanical output pin 25 now has a reflective angled surface 93 that can not only block the beam going to optical sensor 84, now referred to as "Channel 1", but can now re-direct that light into another optical sensor, the Channel 2 optical sensor 86. This configuration constitutes an A-B switch, or rather, a single-throw, double-pole optical switch. The uniqueness of it is that the modulating member, the mechanical output pin 25, is part of a mechanical S&A design where the position of the mechanical output pin 25 is determined by the action of the actuation slider 82, which is inertially actuated. Note that the configuration of FIG. 10*c* is the basis for a more robust switch, since it provides better switching capability for a controller that uses dual state functioning, thus eliminating false states resulting from component failure.

Figure 11:
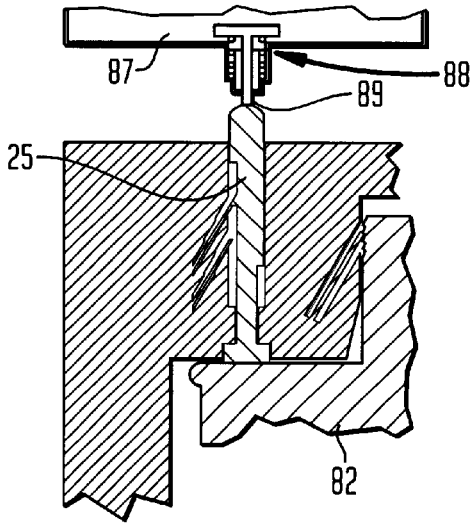
FIG. 11 shows a sectional plan view of the mechanical output assembly operating a fluidic valve.

Referring to FIG. 11, a fluidic valve for mechanically closing or opening a fluid vessel is shown. In FIG. 11, the output of the mechanical output pin 25 deflects a sprung valve by pushing on plunger 89, which opens a fluidic valve 88 into a fluid reservoir 87. A similar action can be where an end of the mechanical output pin 25 is sharp which in turn when extended, can puncture the reservoir to allow some payload to leak out (a dye, an electrolyte, a gas, or other fluid).

Figure 12A:
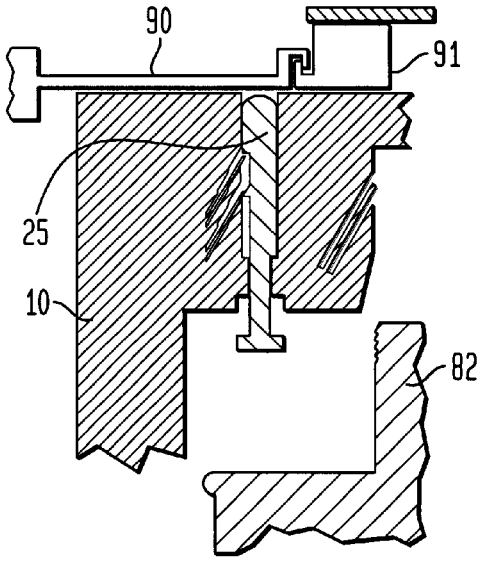
FIGS. 12*a* and 12*b* show sectional plan views of the mechanical output assembly's pin releasing a mechanical slider and its operation in a latched and enabled state.
Figure 12B:
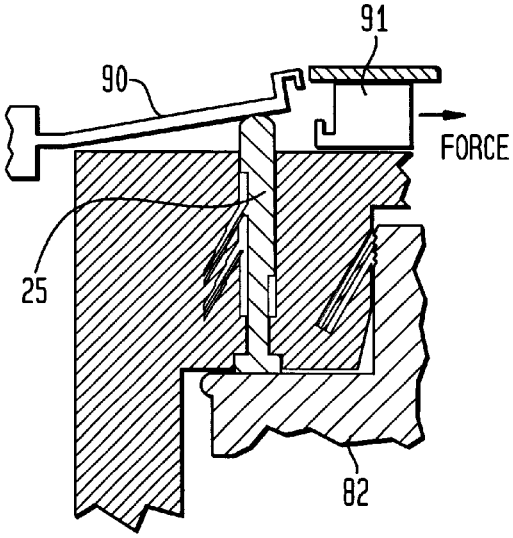

Referring to FIGS. 12*a* and 12*b*, mechanical enablement of some other device is shown, such as lifting or displacing a catch or latch attached to another device so as to be free to move. In FIG. 12*a*, the undeflected latch arm 90 has a feature that holds the enablement slider 91 captive. In FIG. 12*b*, when the mechanical output pin 25 is extended by the action of the actuation slider 82 the result is to deflect the latch arm upward so that its feature disengages with the enablement slider 91, thus freeing it to move to the right as shown.

Figure 13A:
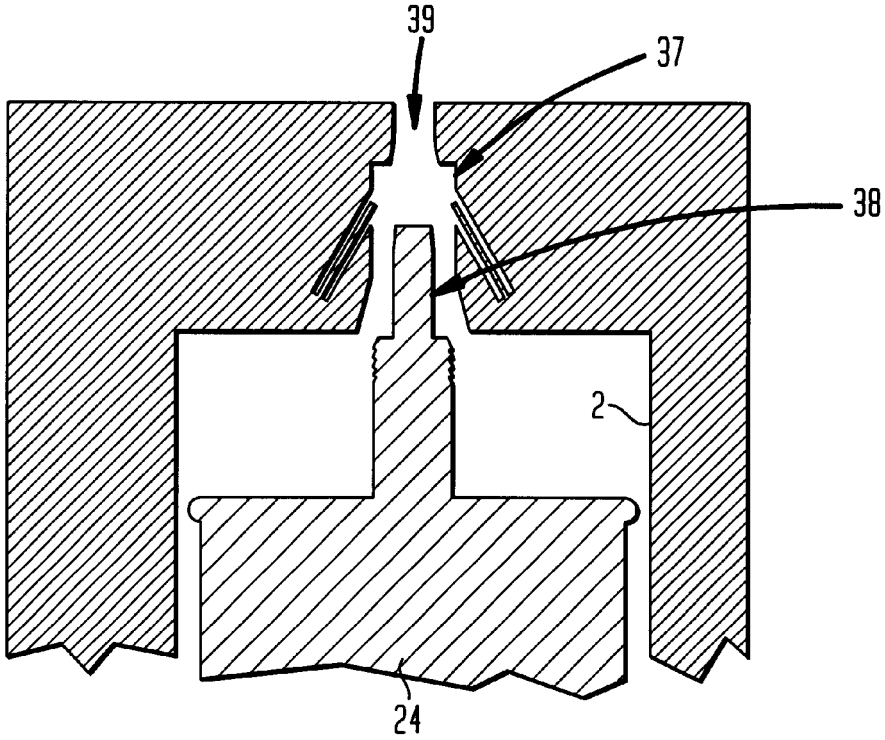
FIGS. 13*a* and 13*b* show sectional plan views of a mechanical output assembly made integral with a set forward slider forming a lance member that can extend through a hole in the device die in a retracted and extended state respectively.
Figure 13B:
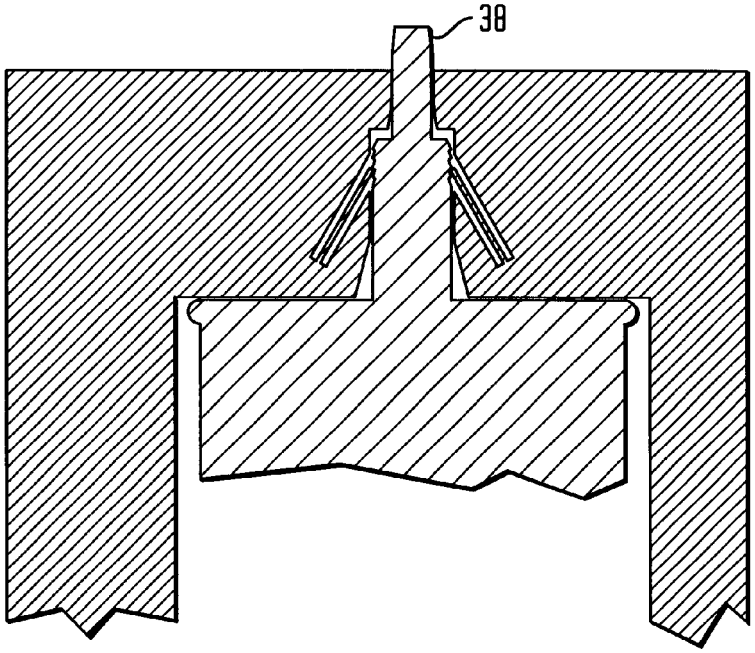

Referring to FIGS. 13*a* and 13*b*, views of a mechanical output pin assembly made integral with a set forward slider lance member 38 is shown. The lance member has an integrally extending output pin member that can extend through a hole 37 in the device die. The lance member 38 can mechanically block the motion of some other device (that is, act as a catch or detent with some other physical element that is placed adjacent to the mechanical output lance member 38 such as a member that can mechanically puncture a diaphragm or provide torque, tension or compression to a spring-like device.

In summary of the above designs of the output pin 25, such a member can be designed to extend different stroke lengths, or can be made wider or narrower, depending on the requirements of the application and the function it is to perform. This mechanical output pin can translate the mechanical functioning and arming of a MEMS-type mechanical S&A device in chip die into a physical output that is usable by the munitions fuze that the die is part of. In a preferred embodiment, the output pin is integrated with the "land" 10 part of the die by a thin wall that keeps the chip sealed, but does not prevent the output pin from being pushed out on its way to the extended position.

All these forms of the output pin relay assemblies could be useful in an application where sense and actuation events are required in a certain timed sequence to assure both safety and reliability, as in the fuze safety and arming device, as discussed above, or an event history indicator. Hence the mechanical output pin assembly is one way to produce a positive mechanical output to an electromechanical assembly such as a fuze system, an optical system, an actuator, or a safety system.

Figure 14:
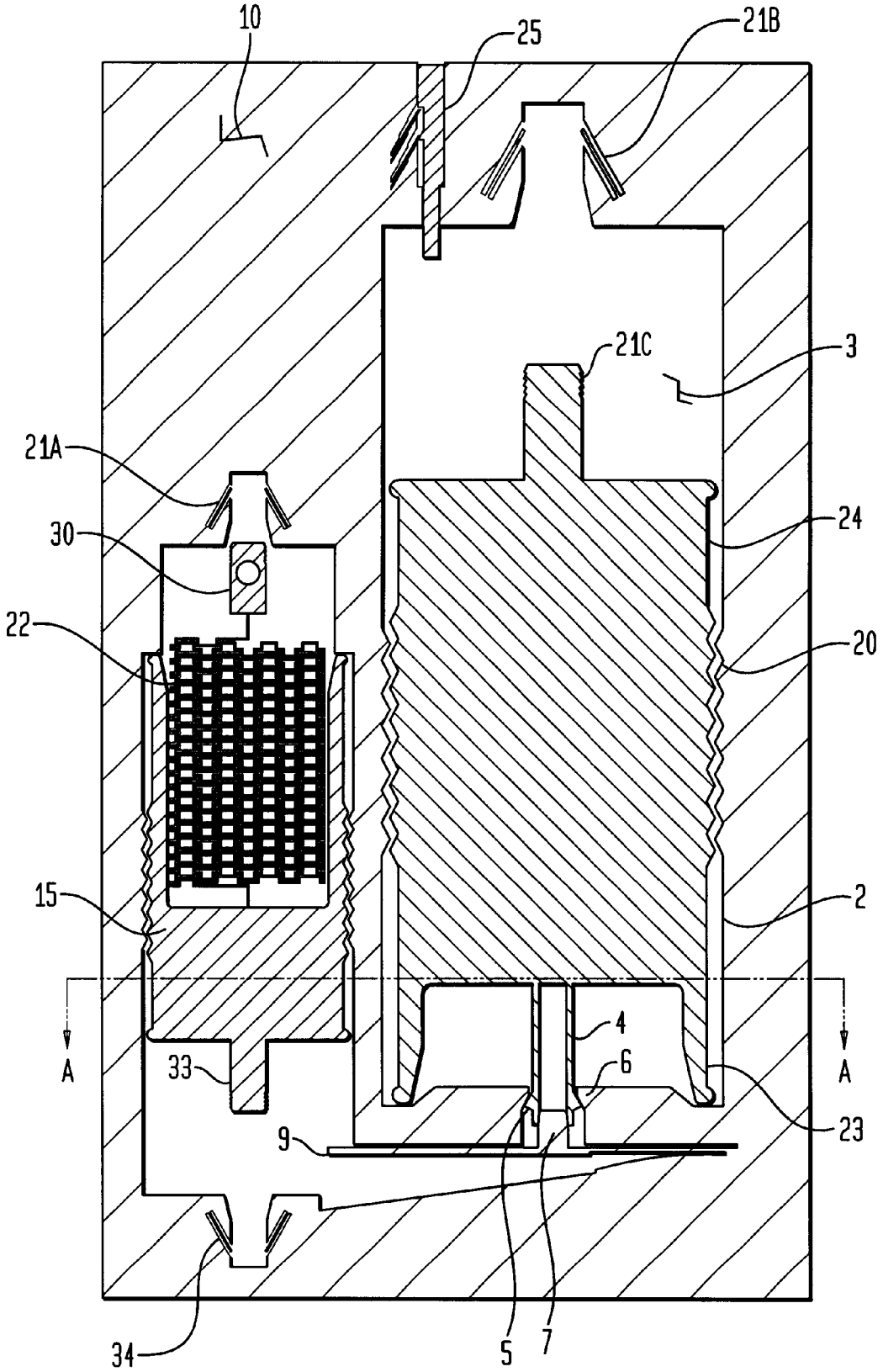
FIG. 14 shows a sectional plan view of a fuze safety and arming device that includes anchor latch and release assembly of FIG. 1 and the output pin assembly as similarly shown in FIG. 6.
Figure 15:
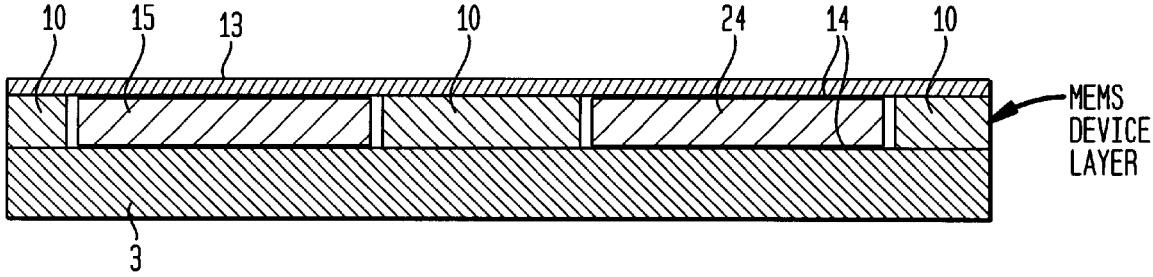
FIG. 15 shows a cross-sectional view of cutaway line A—A shown in FIG. 14.

Referring now to FIGS. 14 and 15, a preferred mode of using the invention is shown that uses the latch and release anchoring assembly and one form of the output relay assembly in a S&A device of a fuze. This device comprises a setback slider 15, a reset spring 22, a reset spring bias head and bias-head latch 30, 21*a*, a setback slider foot or boot 33, an end-of-travel setback slider lockdown latch 34, a linchpin release arm 9, a linchpin 7, a set forward slider 24 with anchor legs 4 and support legs 23 that can move inside a slide track 2, a latch constriction 6 that holds set forward slider anchor feet 5 secured, an end-of-travel latch features 21*b* and 21*c* for the set forward slider, a latching mechanical assembly with output pin 25, a "land" structure 10 in the same plane as the above moving components, in which is fixed to the substrate 31.

In operation, the movable components are 30, 22, 15, 9, 7, 24, and 25 that are supported by the substrate base 31 there under with a cover plate above so that their motion is constrained to the plane of the die. The output of this device is to extend the latching mechanical output pin as a result of inertial inputs to the device. The reset spring bias head is manipulated into the latch 21*a* prior to packaging so that the spring has bias tension. Under logistic handling and transportation, the set forward slider remains latched at the bottom of the track because of the linchpin/constriction arrangement. The setback slider apparatus is designed so that only an input corresponding to gunfire or launch setback acceleration is capable of working the slider member down the track (can be a zig-zag track and the slider member can be spring biased) to deflect the linchpin arm. Once the setback mass experiences launch and deflects the linchpin arm, the linchpin is removed from between the anchor feet. The support legs 23 prevent a downward inertial force on slider 24 from overloading or breaking the anchor legs 4 and anchor feet 5 or linchpin release arm 9. Once the set forward slider is unlatched it is free to respond to an inertial input (acceleration) that would move it upwards. This acceleration can be the result of air drag or target impact or other inputs, in the application of a munitions fuze. Under the acceleration, the set forward slider travels upward gaining momentum until it strikes and pushes out the mechanical output pin. The output pin is designed to remain in its home position during any realistic inertial inputs that affect the two sliders, and to be movable only as a result of the force supplied by the momentum and greater mass of the set forward slider. Once pushed upwards by the force supplied by the set forward slider, the mechanical output pin latches in its extended position. This extended position has some specific functionality associated with it as discussed above in the third embodiment of the invention. There is an optional feature of a zig-zag delay track 20 for the set forward slider, to provide a time delay through energy wastage, where such a time delay might be valuable. This could be valuable in fuze safety and arming functions where a time delay translates into greater safety because it imposes a greater specificity upon the inputs that can successfully move the slider to it's output-inducing position, or perhaps it guarantees a minimum "overhead safety" while the munitions moves away from the launch tube.

The operational sequence of this device In FIG. 14 is as follows: a) Before packaging, the spring bias head 30 of the reset spring 22 is manipulated upward into the pre-biasing latch 21*a*, where it becomes permanently latched in place, leaving the spring in tension. Once that is done, the package is closed by a cover plate 13 that seals the moving devices 15 and 24 primarily between the substrate 31 and the cover plate (FIG. 15), but leaves a working clearance; b) During handling and transportation operations with a system in which the device that the S&A device of FIG. 14 is mounted (for example, in an artillery fuze) various impacts and vibrations are external inputs to the device. Set forward slider 24 cannot move because it is latched at its anchor feet 32. The linchpin release arm 9 is designed with a restraint (not shown) that prevents it from moving except under the load imposed by setback slider 15 when functioning. The setback slider "functions" by deflecting downwards in its track, working against spring tension. Spring tension sets a certain acceleration threshold below which there is no movement. It goes a distance that depends on the acceleration-time product of an input acceleration pulse along its axis in the "up" direction. This product equates to a change of velocity, or "delta-V." If the pulse is from a sharp impact, e.g., the device (e.g., a fuze) was dropped onto a concrete floor or a steel deck, and the net delta-V is less than a certain threshold for which the device has been designed, then the setback slider goes only a fraction of the distance down the track towards the linchpin release lever. It is resisted in its motion by the reset spring 22 and by energy wastage in the enforced zig-zag motion down the track.

This zig-zag feature of the device is disclosed in my U.S. Pat. No. 5,705,767 entitled, "Miniature, planar, inertially-damped, inertially-actuated delay slider actuator," which is hereby incorporated by reference. In particular, this patent teaches of a miniature, planar, inertially-damped, inertially-actuated delay slider actuator that is micromachined on a substrate that includes a "slider member," with zig-zag or stair-step-like patterns on the side edges interacting with similar vertical-edged zig-zag patterns "teeth" on "racks" that are positioned across a small gap on each side of the "slider."

When the zig-zag feature 20 is used with the present invention, it can be used with either of the sliders 15 or 24. In each case, the slider is drawn along the tracks such that the edges of the sliders engage teeth of the cooperative rack members. The zig-zag rack and track members cause the sliders to move back and forth as it slides along faces on these racks, until thrown clear of both racks. In the case of slider 24, the slider zig-zags under inertial forces as it moves axially down the track toward the end thereof to sequentially effectuate actuation of the output pin 25, thus enabling required mechanical time delay for requisite operation. An example of a need for this feature would be where there is a need for delay for turning on of a projectile test instrumentation package until the munitions round has nearly exited the gun.

Also, referring to FIG. 14, if the pulse exceeds the minimum threshold acceleration and the delta-V threshold, as in a valid launch of a the associated munitions in which the subject device is mounted, the setback slider 15 will have time to zig-zag all the way down its track, go into a short "free fall," and then push down on the linchpin release lever 9 while the slider also latches its "foot" 33 into the end-of-travel lockdown latch 34. At this point, the set forward slider has been immobile. It has been prevented from operating "out of sequence" by the invention anchor lock. But since the linchpin is retracted, the set forward slider can move upward during an imposed downward acceleration of the chip. Thus, the action of the zig-zag slider has "enabled" the second slider by virtue of the invention device.

The device shown in FIG. 14 also exhibits the following characteristics: Forces exerted by the first actuator, a MEMS-type component, can be relatively small. These forces can be produced by: a) an inertial-driven setback slider 15, during launch from a gun, b) the action of any other inertially-powered actuator such as a rotor, wedge or cam, which impinges on linchpin arm 9, c) a MEMS-type electrical, thermal, or magnetic actuator or micromotor acting on a command from the system (fuze) circuit. These actuating forces are much smaller than the forces held off by the anchor latch during a 5,000 to 100,000-G mishandling impact or breech loading operation.

The first case, in which the actuator is the setback zig-zag slider, will be discussed here, but the main points will apply as well for the other two types of actuators, (b) and (c). The slider 15 is meant to act under the high G's of gun firing, while the set forward slider is to act under a considerably smaller acceleration in the opposite direction. Meanwhile prior to launch the anchor lock must hold off all inertial inputs to set forward slider 24 before it is released by the action of the first actuator upon the linchpin arm. So, the unlatched device (device with linchpin retracted) is able to operate sensitively under relatively low loads, while previously being in the pinned state it is able to hold off relatively very large spurious loads. This characteristic makes this simple device quite valuable for accomplishing the sequential lock (mechanical logic) functions essential to safety devices such as fuze S&As. As a quantitative example, consider a case wherein a set forward slider in the implementation in FIG. 14, has a mass that is four times that of the setback slider mass. Given the requirements that the setback slider mass has to operate during launch under a sustained 2,000-G pulse, while the unlatched set forward mass must operate under a set forward load of approximately 200-G, but must not pull loose while latched under a 10,000-G mishandling impact. The ratio of the force held off by the anchor during handling impact to the force exerted by the setback slider on the linchpin lever is approximately a 1000-fold. The invention allows the anchor latch pin to be released using a force equal to P while also being able to resist pullout forces equal to 1000*P. The device responds to inertial loads that act within the plane of the device, and is relatively insensitive to inertial loads from out of the plane of the device. An inertial load (acceleration) going perpendicular to the plane of the device will tend to load the moving parts in friction against the substrate or cover plate. But in the main application of munitions fazing, these lateral/perpendicular loads, called "balloting loads," are usually very short in duration and may not impede the ultimate motion of the moving parts. There can be a significant delay between the time that the slider mass is "enabled" to move by the retraction of the linchpin and the time when the mass actually moves its anchor feet out of the lock. Thus the position of the linchpin either enables or disenables the mass to respond to an upward force. By enabling or disenabling the lock at various times, the MEMS-type device using the invention can include time-dependent responsiveness capabilities.

The output pin assemblies of the invention's third embodiment, provide mechanical output mechanisms that can perform a variety of relay functions. These functions depend on an intended device that is interfaced with the mechanical output pin 25. The "output" of the mechanical output pin 25 is the movement from a retracted, nested position (FIG. 8*a*) to an extended or deployed position (FIG. 8*b*) where it can interact with other entities or create an effect outside the bounds of the chip on which the MEMS-type device is mounted.

A closer view of the output pin assembly using one design of this embodiment as seen in FIG. 14 is shown in FIG. 6*a*, 6*b*, 6*c* and 6*d*, in the expanded view. The ratchet tooth 26 on the pin is engaged with stiff lower latch finger 27 to prevent the pin 25 from moving under inertial self-loads until the more massive set forward slider 24 moves upward and forcibly pushes the pin past the lower finger and also past the upper finger 28. Once the ratchet tooth 26 is pushed past and above the upper finger, the upper finger 28 engages with the underside of the ratchet tooth, and prevents the pin from retracting again into the MEMS chip. Thus the mechanical output pin latches in the deployed state. The sides of the output portal 29 support and guide the output pin. An alteration to the design is to add a thin break away wall 35 that is a bridge to the "land" area 10. This can be made for the output pin to punch through or break away from, so that the MEMS chip can remain sealed until the output pin 25 is deployed. The force of the actuating slider 24 is great enough to sever the break away wall on the pin 25 and push it out. The break away wall might also make the lower latch unnecessary, since the walls or bridges will hold the output pin in place until it is deployed by the set forward slider.

Another configuration for the mechanical output pin 25 would be to place the pin at the end of the set forward slider that it comprises a lance member 38 as shown in FIGS. 13*a* and 13*b*, that would push through a hole 39 in the top of the set forward slider latch socket 37. By contrast, the pin 25 has precision stops so that it is located exactly where desired at the end of its travel. This precision of motion is highly desirable. When the output pin 25 in the form of a lance 38 is attached to a set forward slider 24 as previously discussed above, a) there can be significant lateral play because of necessarily large lateral clearances that allow the slider to travel up the track 2, b) the set forward slider does not necessarily engage all the way up into the latch socket 37, so the vertical position of the slider would be uncertain, and c) if it were desired to seal the die, there would be a thin wall that the "lance" has to penetrate to be deployed from the die.

Methods of Use and Making

The various designs of the invention, as discussed above, can be used to provide miniature MEMS-type devices for use in various commercial and military applications. Environments in which the invention can be used include sea and water-type vehicles, space borne instrumentation packages, and all types of safety and emergency response systems. Various MEMS-type devices can function in non-lethal weapons, by virtue of their small size and light weight.

Fazing applications of the MEMS-type mechanisms of the first embodiment of the invention include: a) mechanical safety and arming devices for munitions that include gun-launched munitions and tube-launched rockets or missiles, mechanically safing fuzes, mechanically arming fuzes, mechanically dudding fuzes, mechanically indicating the arming status of fuzes, inertially-activated switch (G-switch) to carry signal or power as discussed in my related applications as referenced above; b) amplification of the motion of a small MEMS-type slider or rotor into the release of a larger and more massive slider member; c) all of the aforementioned applications wherein the actuator that controls the linchpin is not necessarily inertially motivated but could be motivated using a number of principles such as thermal, shape-memory-alloy, electromagnetic, electrostatic, and so on; d) all of the aforementioned applications wherein the "slider mass" is replaced by other MEMS-type components such as a tab, rod, switch link as examples, that incorporate the anchor foot assembly; e) providing a releasable lock-down for a moving component of a MEMS-type device; f) providing a time-gated sensitivity for the anchored component, by allowing control thereover when the linchpin is retracted or inserted, thus, the sensitivity of an inertial slider or the enablement of a MEMS component such as a rod, tab, or a switch in the fuze S&A can be controlled in time by an output of the fuze logic circuit that actuates the linchpin. By this means, for example, overhead flight safety can be effected with no loss of sensitivity by the slider member by using the invention to "gate" when the linchpin enables the device. A programmable fuze could set the enablement window based on information about the intended flight; g) providing the basis for fuze safety and arming devices for non-lethal projected weapons, by virtue of the small size and therefore light weight of the MEMS S&A compared to a conventional S&A device. The MEMS-type devices are much smaller and therefore less massive, and can be considered "frangible" when part of a non-lethal fuze assembly.

Non-fuzing applications of the first embodiment of the invention include: a) impact threshold indicator; b) indicator/latch/switch for space vehicle applications; c) automotive switches and safety devices; d) event sequence indicator; e) arming or enablement indicators; f) launch environment verification; g) impact verification h) inertial environment sequence verification for crash diagnostics, accident forensic analysis, or event sequence re-creation—a "what happened first" indicator for industrial equipment accident situations in industrial plants, aboard air vehicles, in potential terrorist bombing targets, trains, water craft, aboard missiles etc. By positioning numerous of these devices in different orientations throughout an assembly, vehicle, boat, or plant, etc., the initial direction and threshold of an inertial input (impact acceleration or blast, etc.) can be determined using these un-powered, mechanically-, visually-, or electrically-interrogatable devices; i) an enable device for various MEMS-type actuators; j) providing a time-gated sensitivity for the anchored component, by allowing control over when the linchpin is retracted or inserted. Thus, sensitivity of an inertial slider or the enablement of a MEMS-type component such as a rod, tab, or a switch in the fuze S&A can be controlled in time by an output of a controller or logic circuit that actuates the linchpin. In this way the invention can be used as a hold-down or lock for a sensitive MEMS-type component or sensor during a non-active period during which impact or acceleration or thermal inputs might damage the device. This could be during any phase of a deployment such as launch of a space vehicle, missile, rocket, or projectile, or during handling and transportation. Then when the sensitivity of the component/sensor is required, use the invention to release it, and later to catch or lock it down again; k) miniature mechanically-based lock and enabling device or security device for electronic systems. The invention offers a ready compatibility with electronics packaging and in doing so can function as a mechanical enable for an electronic system, a "mechanical firewall"; l) The above, including a configuration in which a number of these devices are placed in parallel or series so that a binary or other mechanical code can be used to lock/unlock the electronic system or computer through an interface of this device on a computer circuit board; and m) non-lethal weapons applications where it is desired to fire a low-speed "frangible" projectile at people or animals to immobilize them with some effect (stun charge, flash, entanglement net), without causing severe physical injury if there is an inadvertent direct impact on a person or animal. To do this, a small, inexpensive, and lightweight S&A or mechanical enabling device is needed as part of a "frangible" projectile.

Applications of the second embodiment of the Invention in fuze devices includes: All the fuzing applications of the first embodiment of the invention along with: a) providing a lock-down for a movable component of a MEMS-type device, a lockdown that is releasable, lockable, and then re-releasable; b) providing a time-gated sensitivity for the anchored component, by allowing control over when the linchpin is retracted or inserted. However this now extends to controlling the times during which the anchor can be re-inserted, by controlling the linchpin.

Applications of the second embodiment of the invention in non-fuzing use include: all the non-fuzing applications of the first embodiment as discussed above and including: a) providing a releasable lock-down for a moving component of a MEMS-type device; b) providing a time-gated sensitivity for the anchored component, by allowing control over when the linchpin is retracted or inserted; c) providing a time-gated sensitivity for the anchored component, by allowing control over when the linchpin can be retracted or inserted. However this now extends to controlling the times during which the anchor can be re-inserted, by controlling the linchpin.

Applications of the third embodiment of the invention using the mechanical output pin assembly include: a) actuating a mechanical switch; b) actuating an output mechanical member; c) actuating an optical switch; d) function as a "telltale" or external indicator that indicates an action or status inside the invention device, such as the one of FIG. 14, that has popped out the pin. The extension of the pin indicates that some action of interest has occurred inside the packaged MEMS-type device that has popped out the pin. The pin will extend beyond the confines of a flipped chip, and the action of its exposure from the chip enables it to perform the functions (actuate a switch, interrupt or re-direct a light beam, release a slider, open a valve, etc) (Note that "flip-chip" technology refers to the technique of creating multi-chip modules wherein one die (a chip diced from a semiconductor wafer), is used as a "substrate" upon which a second die (the "flip chip") is flipped over on top and solder bonded directly to the substrate die, to form a single structurally integrated device. This is often referred to as a multichip module). This external indicator can be used with submunitions to provide a mechanically visible "safe" or "armed" or "dudded" indication to an observer, especially, for example, to an observer such as explosive ordnance experts doing EOD (explosive ordnance destruction). The position of the mechanical output pin or something that it deflects might be viewed through a port or a lens built into the housing of the device, to indicate the safety status of the munitions (This is not to restrict the application of the invention device to "submunition grenades," but to emphasize they are a good application because being a submunition on a larger vehicle means that each individual grenade is subject to the inertial inputs of launch and deployment). Grenades that remain non-functioning on the ground after distribution by an exploding cargo round, for example, will one day have to be cleaned up, and the function of the invention device to furnish a visible safe or dudded indication is valuable to those that have to deal with unexploded ordnance (UXO). Other indicating functions of the output pin assembly, when extended include, punctures a dye reservoir or releases a valve on a die reservoir, so that the dye by flowing out can in turn be observed (e.g., by EOD) through a port or not through a port. The "dye" need not be visible, but could be any detectable fluid whose release indicates the safety status of the submunition. Mechanical event history indicator operating on a MEMS-type device scale wherein the output pin indicates that a certain inertial input threshold has been exceeded. Most commercial unpowered mechanical impact threshold indicators for equipment or shipping are relatively large, as some, for instance, involve the displacement of a spring-loaded ball bearing from a seat. These are approximately one-cubic centimeter in volume. The present device can be extremely small, e.g., on a MEMS chip as small as, for example, 2-mm×2-mm, and can show the same kind of threshold event telltale (though on a smaller scale). The extension of the mechanical output pin indicates that some inertial event has exceeded the design threshold of the device. Same as in e) above but wherein the mechanical output pin assembly, which is extended as a result of the internal workings of its "home" chip, for example the device of FIG. 14, in response to tampering or handling input, functions in its extended state to lock another part of a device to render the overall device safe or inert. As an example, a hand-held inductive fuze setter that could be misused as a "hammer" can be made safer by using this embodiment of the invention where when a hard impact of hammering causes the motivating slider 24 as shown in FIGS. 6–7, to extend the mechanical output pin assembly, whose extension makes or breaks a switch that signals the setter's controller circuit to flash a light or alarm or prevent the setter from functioning until it has been inspected and serviced. One advantage of this embodiment is that it can respond to an inertial input while in an unpowered state, and will create a mechanical record (the extension of the mechanical output pin) that can be observed and interpreted later when the hand-held setter is turned on by an operator. So the setter need not be powered when the damage occurs for the device to perform its recording and indicating function. Thus, in an environment where there may be many people handling the fuze setter at different times, the occurrence of earlier damage or abuse can be determined by any would-be user before the setter is used in a critical situation. The same would apply to handheld radios, hand-held weapon fire control modules, etc.

The applications of the invention further include, but are not limited to, safety and arming for projected pyrotechnics, flown instrumentation packages, and actuators for or in automotive impact sensing and switches or mechanisms used in medical and diagnostic systems. The features and characteristics of the invention include, but are not limited to, development of a device which is planar for providing improved size advantage, and especially a shape advantage, over traditional three-dimensional mechanical fuzes, switches, and assemblies, provision of a device that does not or may not require electrical power to function during initial arming stages, and the various other features and characteristics discussed and described herein.

In the latter discussion, the term "flown instrument packages" indicates an arrangement in which the device, instead of arming a fuze, closes a switch that initiates data recording aboard a tube-launched instrumentation package. The phrase "actuators for or in automotive impact sensing" indicates an application similar to the above "flown instrumentation packages" application but, in the automotive environment, the shuttle with zig-zag feature responds to crash deceleration to work its way down the zigzag track, and it locks down and closes the switch when a certain minimum change of velocity has occurred. The device also can act as a mechanical impact switch that closes upon first impact, with the crushing of the vehicle structure, for example. The inertial switch closing constitutes detection that closes a switch at its end of travel, and this fires an airbag or other automotive safety device. Thus, the present invention is not necessarily limited to fuzing S&A applications.

In summary, the invention generally relates to the field of mechanical S&A devices for projectiles and munitions fuze S&A devices using micromachining, microscale device and MEMS technologies. As described above, the invention disclosed herein preferably is used in a mechanical fuze S&A device on a single die. Any solid material or combination of materials can be used to form the shuttle member, anchor assembly and switching assemblies of the present invention. In the preferred embodiment, the invention includes a slider and racks formed of metal (e.g., nickel) in a LIGA-MEMS fabrication process, but other microfabrication processes or other materials (including other metals, polymers, ceramics or even crystalline materials such as silicon or quartz) can be used. The material chosen is not critical to practice the invention, but such material selection should enable one to produce the device to function as taught herein. The device can be sandwiched between one or more other die that act together to enable arming and safety functions for a fuze.

In addition, the height (relief) of the features is not critical, given the fact that there is enough material for the anchored mass member 1, slide track 2 and one of the designs of the output assembly design interact as intended. Current LIGA processes create features whose top surface is about 200-microns above the substrate, but the device may work just as well with only a 25- or 50-micron height. Any technology may be used to form the device, whether a LIGA-type process or a bulk plasma micromachining technique such as RIE (reactive ion etching), or a surface micromachining technique, or some other process yielding the desired configurations.

Preferably, each MEMS-type device is fabricated on a die approximately one square centimeter or less in area and about 500-microns thick. As mentioned above, preferably, the each device is implemented on a single chip or die, but multiple dies also can be used. In a preferred embodiment of the invention, the device is monolithic in its basic configuration, but also, for practical purposes, can be sandwiched or stacked with one or more die. MEMS-type devices can be readily integrated and interfaced with electronics because they are fabricated much the same way as integrated circuits. The specific MEMS fabrication technique requires only that desired geometric and mechanical and electrical performance characteristics are obtained for an intended application. The moving parts of the latch and release embodiments, that is the anchor mass 1, linchpin 7, and the various output assembly relay designs are freed from the fabrication substrate, and are held in plane by the substrate and a cover plate for protection and reliability of freedom of moving parts. The features that are attached to the substrate 3 and form the land structures 10 are shown that include the anchor assembly's constriction members 6, the track 2 and the surrounding structure. There is a working clearance between the moving parts and the substrate/cover plate planes.

Preferably, each of the various embodiments of the invention in fuze applications is stackable in that the MEMS-type device die can be augmented by sandwiching it between other die or cover plates that add features or functions or provide data pickoff.

In addition, each of the various embodiments of the invention is preferably designed and manufactured with high precision using microfabrication technology, based on optical masks. The device brings with it a high degree of precision, with features on a scale ranging from millimeters in dimension to microns in dimension. Also, the required features may be created using any of a variety of micromachining techniques. The most likely fabrication technology for producing copies of the invention is the high-aspect-ratio (HAR) LIGA technique or other HAR bulk micromachining techniques, such as reactive ion etching, (RIE) or the like, to create the intended features on a planar substrate.

Packaging of the latch, release and output mechanisms in a MEMS-type device can be hermetic with a selection of fill gas. Additionally, by varying certain parameters, a particular MEMS-type device design can accommodate a variety of threshold levels wherein the g-threshold for pull-out of the anchor is set by selection of parameters such as anchor leg dimensions, required anchor foot deflection as discussed in my other related patent application referenced above. Mechanical components, through relatively simple modifications to the wafer exposure masks and MEMS process parameters, can be achieved versus retooling an assembly line with conventional components. Aspects of the latch release assembly and output mechanism performance can be tailored by relatively simple design changes such as for a requisite acceleration threshold, voltage standoff, dwell (plunger travel time as influenced by zig-zag track delay), stroke and/or contact forces.

It will be readily apparent to one of ordinary skill in the art that the present invention fulfills the objectives set forth above. After reading the foregoing specification, those skilled in the art will be able to effect various modifications, changes, substitutions of equivalents and various other aspects of the invention as broadly disclosed herein. It is therefore intended that the protection granted hereon be limited only by the scope of the invention as set forth in the appended claims and equivalents thereof.

What is claimed is:

1. A microelectromechanical systems (MEMS)-type latch and release device fabricated on a common die, the device comprising:

a base;

a slider member slidably mounted on the base a track that guides movements of the slider member;

an anchor assembly having two flexible anchor legs attached to the slider member, movable anchor feet that are attached to distal ends of each anchor leg, the anchor legs cooperatively and slidably engage corresponding constriction members that attach to the base through the anchor feet, and a movable linchpin member, wherein the linchpin member slidably moves between the anchor feet; and means for removing the linchpin member and allowing the anchor feet to move together causing subsequent release of the slider member and movement within the track.

2. The device as recited in claim 1, wherein the anchor assembly further includes a spring member that attaches between the base and the linchpin so that when the anchor feet are pressed into the constriction members, the linchpin is biased by the spring causing reinsertion of the linchpin between the anchor legs and effectuating relatching of the device, thereby providing a relatching device.

3. The device as recited in claim 1, wherein the anchor feet have a catch member that prevents reinsertion of the feet through the constriction members, cooperative interfacing linchpin and the anchor feet have a 5-degree taper angle, thereby providing a one-way latch-release device.

4. The device as recited in 1, wherein the slider member is juxtaposed to a zig-zag track on each side of the slider member, in which the slider member slides, the slider member has teeth members on each side of the slider member that cooperatively slidably engage the zig-zag track members, thereby enabling time-delay for travel of the slider member when subjected to inertial loading.

5. The device as recited in 2, wherein the slider member is juxtaposed to a zig-zag track on each side of the slider member, in which the slider member slides, the slider member has teeth members on each side of the slider member that cooperatively slidably engage the zig-zag track members, thereby enabling time-delay for travel of the slider member when subjected to inertial loading.

6. A microelectromechanical systems (MEMS)-type output relaying device, the device comprising:

a base forming a single die type structure;

a slider member slidably mounted on the base;

a first track that restricts movement of the slider member;

a slidable output pin that cooperatively engages the slider member, the pin is restricted within a second track such that when the slider member engages the output pin during inertial loading of the relaying device, a distal end of the output pin extends beyond the second track and maintains attachment thereto; and an output effector means having at least two operational states.

7. The relaying device as recited in claim 6, wherein the output pin has at least one catch member attached to at least one side of the output pin, the at least one catch member cooperatively engages at least one recess with a finger catch member within the second track, the second track has a break away section in the die for providing stable positioning of the output pin prior to actuation of the device, whereby the output pin remains latched in an extended position when deployed.

8. The relaying device as recited in claim 6, wherein the output effector means comprises a displaceable mechanical relay member that has at least two states of operation.

9. The relaying device as recited in claim 6, wherein the output effector means comprises an optical switch.

10. The relaying device as recited in claim 8, wherein the mechanical relay member blocks motion of a juxtaposed mechanically actuated device.

11. The relaying device as recited in claim 8, wherein the mechanical relay member enables motion of a juxtaposed mechanically actuated device.

12. The relaying device as recited in claim 11, wherein the mechanically actuated device comprises a diaphragm that is puncturable.

13. The relaying device as recited in claim 11, wherein the mechanically actuated device comprises a fluid valve.

14. The relaying device as recited in claim 10, wherein the mechanically actuated device comprises an electromagnetic (EM) source and an optical fiber wherein the output pin interrupts transmissions of EM radiation when actuated.

15. The relaying device as recited in claim 11, wherein the mechanically actuated device comprises an optical fiber and sensor wherein the output pin redirects the optical fiber towards the sensor when actuated.

16. The relaying device as recited in claim 10, wherein the mechanically actuated device comprises an electromagnetic (EM) source and at least two EM sensors, wherein the output pin interrupts transmission of EM radiation to one of the sensors and reflects radiation from the source to one of the other sensors when actuated.

17. The relaying device as recited in claim 8, wherein the mechanically actuated device comprises an electrical switch.

18. The relaying device as recited in claim 17, wherein the electrical switch is a normally closed type switch.

19. The relaying device as recited in claim 17, wherein the electrical switch is a normally open type switch.

20. The relaying device as recited in claim 8, wherein the mechanically actuated device includes a visual indicator.

21. The relaying device as recited in claim 8, wherein the mechanically actuated device comprises a latch arm and auxiliary slider member such that when actuated, the latch arm releases the auxiliary slider member so as to move within an auxiliary track.

22. The relaying device as recited in claim 6, wherein the slider member attaches to the output pin and the first track is substantially parallel and aligned with the second track.

23. The relaying device as recited in claim 21, wherein a structural centerline of the slider member and the output pin are collinear and form an output lance member.

24. The device as recited in claim 6, wherein a protruding head member attached to the slider member has a catch engagement member that cooperatively engages and latches with contact members attached to a section of the first track during actuation of the device.

25. The device as recited in claim 24, wherein a protruding head member attached to the slider member has a catch engagement member that cooperatively engages and latches with contact members attached to a section of the first track during actuation of the device.

26. The device as recited in claim 24, wherein the second track has a break away wall that bridges to the die and an initial stabilized and sealed configuration can be maintained until the output pin breaks away from the die and deployed.

27. A safety and arming (S&A) device for a projected munitions formed on a common substrate, comprising:

setback slider means responsive to acceleration of the munitions for moving from an initial position to a final position on the base within a first track;

set forward slider means responsive to movement of the setback slider means for moving, from an initial position toward a final position on the base within a second track;

an anchor latch and release assembly that includes two flexible anchor legs attached to the set forward slider member, movable anchor feet that are attached to distal ends of each anchor leg, the anchor legs cooperatively and slidably engage corresponding constriction members that attach to the base through the anchor feet, and a movable linchpin member, wherein the linchpin member slidably moves between the anchor feet;

an interlocking arm cantilevered and movable at the final position of the setback slider, the interlocking arm attaches to the linchpin member thereby allowing the anchor feet to move together and release the set forward slider member from the constriction members so as to be released and movable within the second track; and a slidable output pin that cooperatively engages the set forward slider means, the output pin is restricted within a third track such that when the set forward slider means engages the output pin during inertial loading of the relaying device, a distal end of the output pin extends beyond the third track and remains attached thereto.

28. The device recited in claim 27, wherein the output pin interfaces with an output effector means having at least two operational states, thereby effectuating relaying action.

29. The device as recited in 27, wherein at least one of the slider means is juxtaposed to a zig-zag track on each side of the at least one slider means, in which each of the at least one slider means slides, the at least one slider means has teeth members on each side of the respective slider means that cooperatively slidably engage the zig-zag track members, thereby enabling time-delay for travel of the at least one slider means when subjected to inertial loading.

* * * * *